United States Patent [19]

Seibt

[11] 4,333,182

[45] Jun. 8, 1982

[54] BUTTON ANCHOR METHOD AND APPARATUS

[76] Inventor: Judith Seibt, P.O. Box 4304, Winter Park, Fla. 32793

[21] Appl. No.: 299,781

[22] Filed: Sep. 8, 1981

[51] Int. Cl.[3] ..... A47C 23/02; A44B 1/30; A44B 1/18

[52] U.S. Cl. ..... 2/265; 24/90 R; 24/104; 24/111

[58] Field of Search ..... 2/265; 24/90 R, 90 TA, 24/90 E, 90 C, 94, 95, 103, 113, 150 FP, 104, 111; 264/248

[56] References Cited

U.S. PATENT DOCUMENTS

| | | | |
|---|---|---|---|
| 1,297,321 | 3/1919 | Carruthers | 24/94 |
| 1,483,880 | 2/1924 | Hapeman | 24/100 S |
| 1,700,169 | 1/1929 | Kramer | 24/111 |
| 2,175,029 | 10/1939 | Richmond et al. | 24/90 TA |

*Primary Examiner*—Doris L. Troutman

*Attorney, Agent, or Firm*—William M. Hobby, III

[57] ABSTRACT

A button anchor apparatus has an elongated elastic thread having an elongated needle portion formed on one end thereof and an elongated ferrule formed on the other end of said elongated elastic thread and having a bore formed in one end thereof. The ferrule bore is adapted to accept the needle for locking the button to the garment. A method of attaching a button with a button anchor apparatus is also provided including the steps of pushing the needle through the garment, threading the elastic thread through the button and back through the garment, then attaching the end of the needle into the open end of the ferrule by stretching the elastic thread to allow the elongated needle to be aligned with and inserted into the ferrule bore.

6 Claims, 6 Drawing Figures

BUTTON ANCHOR METHOD AND APPARATUS

BACKGROUND OF THE INVENTION

The present invention relates to a button anchor apparatus and method and especially to a button anchor adapted to rapidly attach a loose button back onto a garment.

The common way of attaching a loose button involves the use of a threaded needle having a thread of the same general color of the garment and to sew the button through a series of stitches made through the holes in the button. This, however, is time consuming and impractical when away from home, such as when traveling, so that it has become common to merely keep the button with the possibility of losing it before one returns home. A lost or missing button gives an untidy appearance to the wearer of garments.

The present invention provides for simple anchors or fasteners which still utilize threads, but which can be carried with an individual, such as when traveling, to rapidly attach a button. The button anchor in accordance with the present invention includes use in the fitting room to reposition buttons on garments until they conform to the customer's contour or to his satisfaction before a purchase is finalized. An anchor on the underside of a garment serves the same purpose as the backing buttons on suits and jackets. It protects any garment material from damage due to strain on the button; and buttons which are harmed by cleaning fluid can be removed and reattached to garments.

Prior art button fasteners can be seen in U.S. Pat. No. 1,334,656 for a Combined Button and Fasterner; and in U.S. Pat. No. 653,655 for a Button or Stud; both of which patents operate more in a nature of removable buttons attached to tuxedos, or the like. A series of prior art U.S. patents use metal staples or pins for automatic or manual attachment of buttons to garments and these may be seen in U.S. Pat. Nos. 1,988,233 for a Button Fastener; 2,058,020 for a Self Fastening Button; 2,624,085 for a Staple for Attaching Buttons; 2,597,051 for a Temporary Button Fastener; 947,557 for a Button Fastening Means; 2,935,434 for a Method of Securing a Button to a Fabric by Means of a Thermal Plastic Pin; and 2,104,885 for a Button Fastener; 1,124,540 for Fastening Device; and 1,706,576 for a Button Securing Device.

In contrast to these prior art devices, the present invention is readily adapted for an individual user to attach a button in a few seconds wherever the button becomes loose and has an elastic thread which allows the repaired button to look more like the existing buttons on the clothes. Advantageously, the button can be quickly removed without damaging the clothes.

SUMMARY OF THE INVENTION

A button anchor apparatus and method of attaching a button are provided for rapidly attaching a button that has come off or become loose on a garment.

The button anchor apparatus has an elongated elastic thread having an elongated needle portion formed on one end thereof and an elongated ferrule formed on the other end of the elongated elastic thread. The ferrule has a bore in one end thereof adapted to insert the elongated needle portion so that when a needle portion is pushed through a garment, the elastic thread can be stretched to allow the needle portion to be inserted axially in the bore of the ferrule.

A method of attaching a button with a fastener in accordance with the apparatus is provided in which the needle portion is pushed through the underside of a garment cloth at the point where the button is to be fastened and in the same motion threaded through one hole in the button. The button is then held firmly against the material before threading the needle point down through the second hole and garment cloth in the same operation. This method of insertion insures equal distance between the points where the garment material was pierced and the space between the holes in the button and acts as a safety measure to prevent the needle point from slipping out of the ferrule in time of undue strain on the thread. The needle is then attached to the ferrule by slightly stretching the thread and inserting the needle into the ferrule bore. The elastic member is of a length that it will remain slightly stretched to hold the needle locked into the ferrule.

BRIEF DESCRIPTION OF THE DRAWINGS

Other objects, features and advantages of the present invention will be apparent from the written description and the features, in which:

FIG. 4(*b*) is a perspective view of the second step in attaching a button to a garment; and FIG. 4(*c*) is a perspective view of the third step in attaching a button to a garment.

DESCRIPTION OF THE PREFERRED EMBODIMENTS

Figure 1:
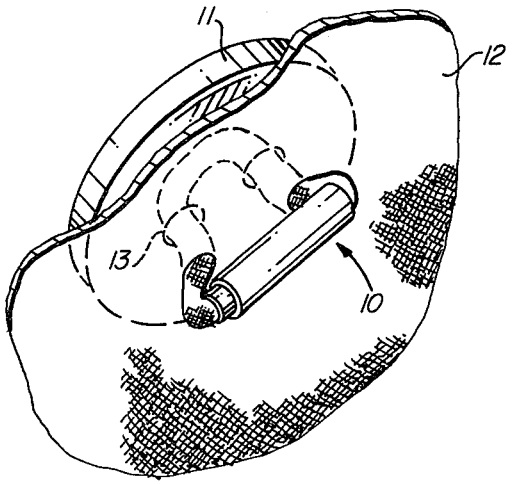
FIG. 1 is a perspective view of the present invention attached to a button on a piece of cloth.
Figure 2:
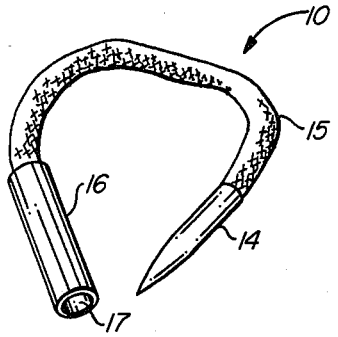
FIG. 2 is a perspective view of the button anchor in accordance with the present invention.

FIG. 1 shows a button anchor 10 attaching a button 11 to a garment 12. The button 11 has two holes 13 therein. The button fastener 10, as shown in FIG. 2, has a needle portion 14 attached to an elongated elastic portion 15 which can be an expandable polymer material or a bungee thread or any other elastic or expandable material desired. The elastic material 15 would normally be made in several colors, especially black and white, to match the button and garment or clear monafilament so color can be seen through it. The button fastener 10, however, is so small that several can be carried with an individual when traveling, or kept at the office, or other location, for readily reattaching a loose button.

A ferrule 16 is attached to the other end of the elastic thread 15 and has a bore 17 in the other end thereof. In the embodiment shown, the needle portion 14 is a pointed metal member attached to the elastic thread, such as a neoprene elastomer by swaging or compressing, while the ferrule 16 is similarly a metal member, but is should be clear that members 14 and 16 can also be of any polymer desired and the entire button fastener 10 can be made from two compatable molded polymers molded in one operation in an injection mold.

Figure 3:
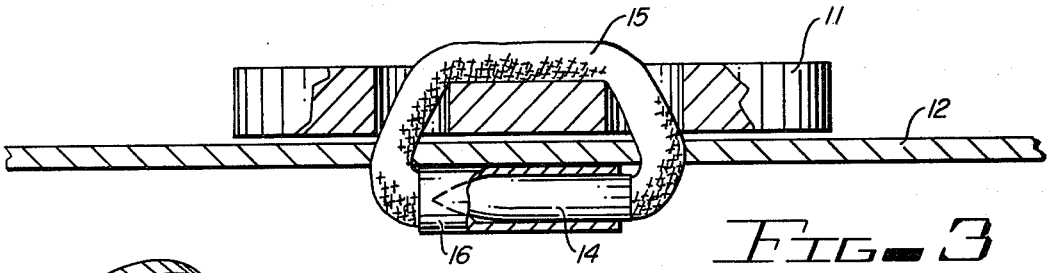
FIG. 3 is a sectional view taken through a button attached to a garment with the present button anchor.

In FIG. 1, the needle portion 14 has been inserted in the ferrule 16, while in FIG. 3 it has been released so that the elastic portion pulls the button 11 and the ferrule 16 tight adjacent the garment. The elastic thread 15 advantageously allows the button to give slightly for buttoning through button holes of thicker garments and gives or moves with body movement.

Figure 4A:
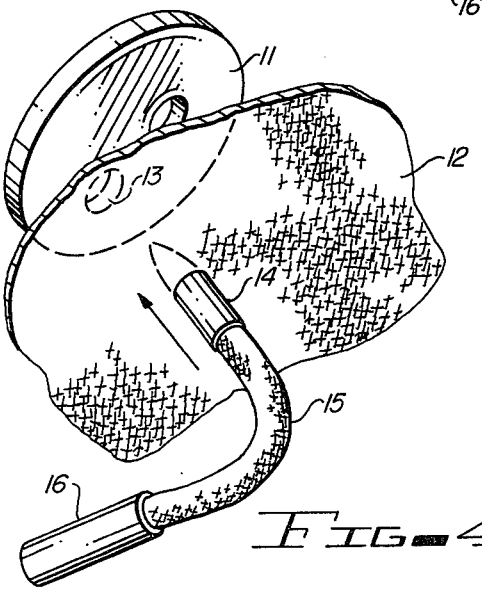
FIG. 4(*a*) is a perspective view of the first step in attaching a button to a garment.
Figure 4B:
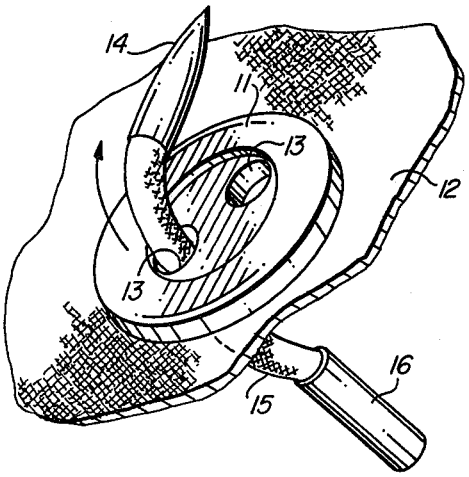
Figure 4C:
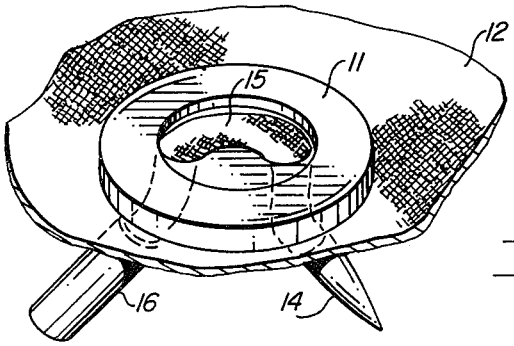

The present button anchor can be more clearly seen in FIGS. 4(*a*) through 4(*c*) in which the needle portion 14 is being inserted through the back side of the garment 12 at the location for a button 11. The needle portion 14 then threads the elastic thread 15 through one button hole 13 and the the other, and back through the garment 12 as shown in FIG. 4(*c*). The ferrule is then grasped in one hand while the needle portion 14 is grasped by the other and the elastic 15 expanded to allow the point of the needle 14 to aligh axially with the bore 17 of the ferrule 16, whereupon the button is attached to the garment. Because the elastic member 15 tends to pull at a sharp angle against the needle 14, the needle 14 will remain locked in the ferrule 16 unless sufficient force is utilized to stretch the elastic thread 15 sufficiently to axially pull the needle 14 out of the ferrule 16. Four-hole buttons are attached in the same except the second and third holes need not have thread therethrough. The second and third holes may be threaded to give the top of the button a finished appearance. That is, the thread may be passed through the garment, through two holes, and then through the other two holes and then back through the garment. A final step in the process may include grasping the anchored button with one hand and the attached needle and ferrule in the other hand and pulling them apart to align the attached button. The same attachment method may be used for shank buttons except in the absence of second button hole point goes down through garment after threading it through hole in shank.

It should be clear at this point that a button anchor, as well as a method of attaching a button with a button anchor has been provided. It should be clear that the present invention is not to be considered limited to the forms shown, which are to be considered illustrative rather than restrictive.

I claim:

1. A button anchor comprising:

an elongated elastic thread;

an elongated needle portion formed on one end of said elongated thread; and an elongated ferrule portion attached on the other end of said elastic thread and having a bore in one end thereof, whereby said needle portion can thread said elastic thread through a garment and button and be locked into said ferrule portion.

2. A button anchor in accordance with claim 1, in which said needle portion is locked in said ferrule portion by stretched elastic thread pulling the needle portion at an angle to the ferrule.

3. A method of attaching a button with an anchor having an elastic thread having a ferrule formed on one end thereof and a needle formed on the other end thereof comprising the steps of:

pushing said needle with said attached elastic thread through cloth where a button is to be attached;

threading said needle and elastic thread through a button;

pushing said needle back through said cloth; and attaching the end of said needle into an open end of said ferrule, whereby a button can be readily attached to a piece of cloth.

4. A method in accordance with claim 3, including the step of stretching said elastic thread to align said needle axially with a bore in said ferrule and inserting said needle in said ferrule bore.

5. A method in accordance with claim 4, in which the step of threading said needle and elastic thread through said button twice, one through two holes in said button and a second time through two other holes in said button and then pushing said needle back through said cloth.

6. A method in accordance with claim 4, including the step of pulling said anchored button and attached needle and ferrule apart to align said anchored button.

* * * * *